US006523455B1

(12) United States Patent
Callahan et al.

(10) Patent No.: US 6,523,455 B1
(45) Date of Patent: Feb. 25, 2003

(54) COMPRESSOR HAVING AN OIL COLLECTION GROOVE

(75) Inventors: Rodney James Callahan, Novi, MI (US); Ronald James Mangiapane, South Lyon, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/982,068

(22) Filed: Oct. 17, 2001

(51) Int. Cl.[7] ..... F01B 3/00
(52) U.S. Cl. ..... 92/71; 92/153
(58) Field of Search ..... 92/12.2, 70, 71, 92/153, 154

(56) References Cited

U.S. PATENT DOCUMENTS

| | | | | |
|---|---|---|---|---|
| 2,429,978 A | | 11/1947 | Blanchard | |
| 3,223,196 A | | 12/1965 | Stott | |
| 3,838,942 A | | 10/1974 | Pokorny | |
| 3,945,765 A | | 3/1976 | Toyoda et al. | |
| 4,236,878 A | | 12/1980 | Terauchi | |
| 4,586,876 A | | 5/1986 | Kato et al. | |
| 5,370,505 A | | 12/1994 | Takenaka et al. | 92/153 |
| 5,393,204 A | | 2/1995 | Kawahara | |
| 5,782,316 A | | 7/1998 | Kobayashi et al. | 92/154 |
| 5,937,735 A | * | 8/1999 | Shimizu et al. | 92/153 |
| 6,077,050 A | | 6/2000 | Beck | |

* cited by examiner

*Primary Examiner*—Edward K. Look
*Assistant Examiner*—Thomas E. Lazo
(74) *Attorney, Agent, or Firm*—Brinks Hofer Gilson & Lione

(57) ABSTRACT

A swashplate-type compressor is provided. The compressor has a housing member that defines a plurality of grooves having features that allow the grooves to direct lubricating oil splashed against the housing member toward a central opening that houses a bearing and shaft. Preferably, the grooves comprise an annular groove and a series of oil collection grooves emanating outward from the annular groove. Each oil collection groove has a first wall that is substantially perpendicular to the plane of the housing member and a second wall that is angled with respect to both the first wall and the plane of the housing member. Also, each oil collection groove is in fluid communication with the annular groove. The housing member may further define one or more axial holes disposed within the annular groove.

20 Claims, 2 Drawing Sheets

COMPRESSOR HAVING AN OIL COLLECTION GROOVE

FIELD OF THE INVENTION

The present invention relates to a swashplate type compressor for compressing a gas. More specifically, the present invention relates to a housing member for a swashplate type compressor. The housing member defines one or more oil collection grooves that facilitate distribution of a lubricant within the crank chamber of such a compressor.

BACKGROUND OF THE INVENTION

Swashplate type compressors are frequently used in refrigeration circuits such as those used in automotive applications. These compressors operate through an engagement between one or more pistons and a swashplate. Rotation of the swashplate, which is oriented at an angle to the axis of rotation of a drive shaft, causes the engaged pistons to reciprocate within individual cylinder bores. This reciprocation allows the pistons to compress the refrigerant as part of the mechanical refrigeration process.

There are several points of frictional contact within a swashplate-type compressor. For example, a pair of shoes are typically disposed between each piston and swashplate and swivel within concave pockets as the swashplate rotates. The interface between the shoes and swashplate is an area of sliding contact, giving rise to friction and wear. Also, the drive shaft is typically disposed on a needle or other type of bearing, and rotates while in contact with the bearing. Furthermore, lubrication of the shaft seal is important to compressor functioning. Over time, wear at any of these points of contact can lead to seizure of the compressor, especially in conditions in which lubricant supply is inadequate. This failure mode is one principal limitation on the useful life of a swashplate type compressor.

SUMMARY OF THE INVENTION

The present invention provides a swashplate-type compressor having a housing member that defines one or more channels that are adapted to collect and distribute a lubricant within the crank chamber of the compressor. Preferably, the housing member defines a main aperture, an annular groove disposed around the main aperture, and a plurality of oil collection grooves extending outward from the annular groove. Each oil collection groove is in fluid communication with the annular groove, and has a first wall that is perpendicular to the plane of the housing member and a second wall that is angled with respect to the first wall and the plane of the housing member.

The oil collection grooves are preferably angled in position on the housing member, and each may comprise two linear segments joined at an angle or a curvilinear groove. Also, the second wall of each groove can be curvilinear.

The housing member is particularly well-suited for incorporation into a swashplate type compressor having a cylinder block defining a cylinder bore and a crank chamber, a shaft partially disposed within the chamber, a piston reciprocally disposed in the cylinder bore, a swashplate fixedly mounted to the shaft and disposed within the chamber, and shoes which slideably intervene between the piston and the swashplate.

DETAILED DESCRIPTION OF THE INVENTION

The following description of the preferred embodiments of the invention provides examples of the present invention. The embodiments discussed herein are merely exemplary in nature, and are not intended to limit the scope of the invention in any manner. Rather, the description of these preferred embodiments serves to enable a person of ordinary skill in the relevant art to make and use the present invention.

As used herein, the term "normal direction of rotation" refers to the rotational direction of a shaft in a compressor. These shafts are typically mounted to a motor that rotates the shaft in a single direction. This direction is the normal direction of rotation for the shaft.

Figure 1:
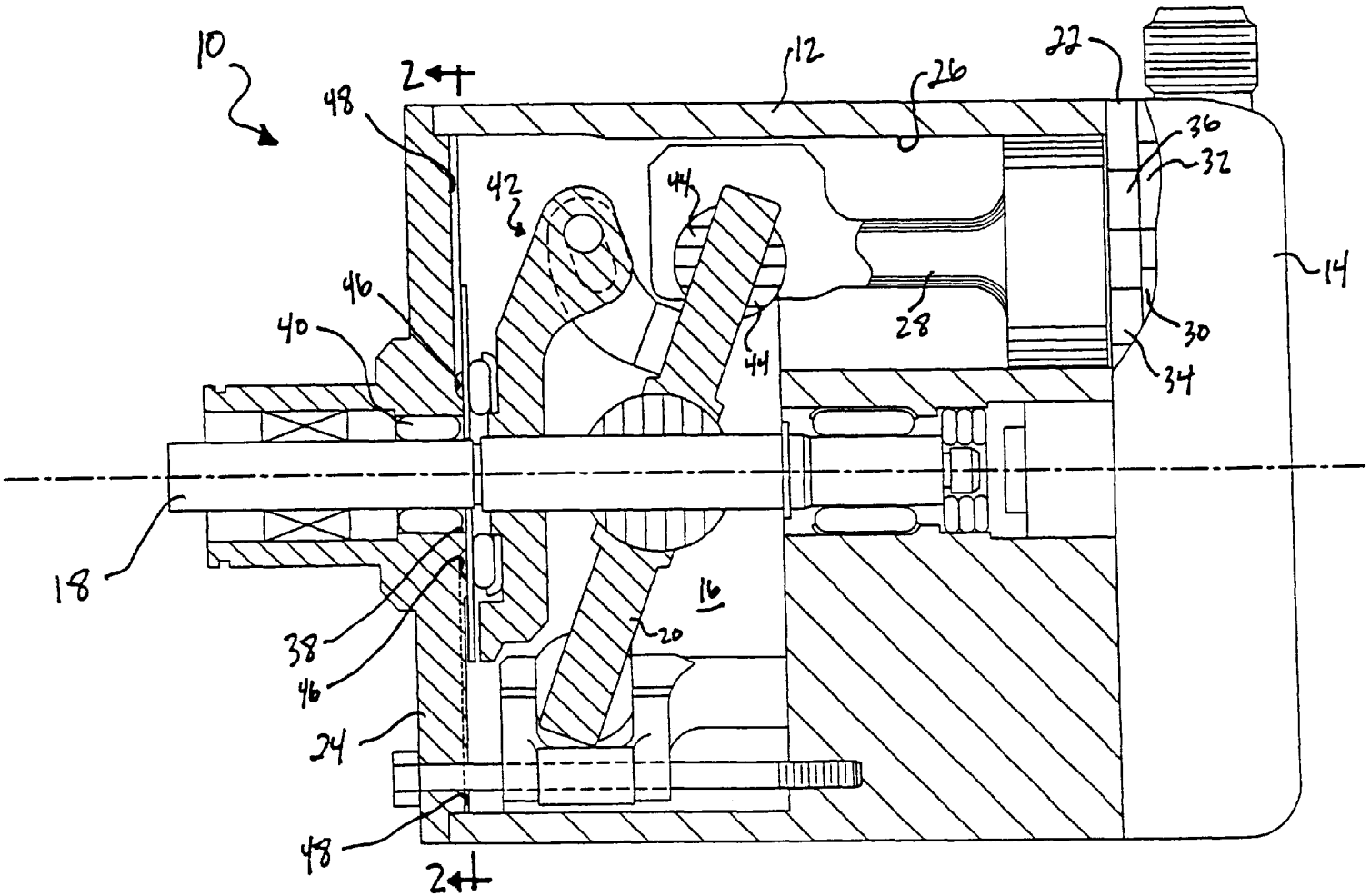
FIG. 1 is a cross-sectional view of a swashplate type compressor having a housing member that defines various oil collection grooves in accordance with the present invention.

FIG. 1 illustrates a swashplate type compressor, generally indicated in the drawing as reference number 10. The compressor 10 includes a cylinder block 12, a rear housing member 14 that defines a crank chamber 16, a drive shaft 18, a swashplate 20, a valve plate 22, a front housing member 24, at least one cylinder bore 26, and at least one piston 28.

The rear housing member 14 defines a suction chamber 30 and a discharge chamber 32, and the valve plate 22 defines a suction port 34 and a discharge port 36.

The front housing member 24 defines a main aperture 38 that receives the drive shaft 18 such that a portion of the drive shaft 18 is disposed in the chamber 16. The front housing member 24 also defines one or more grooves adapted to collect and distribute lubricant, which will be developed more fully below. A bearing 40, such as a needle bearing, is disposed in the main aperture 38 and supports the drive shaft 18 within the main aperture 38.

The swashplate 20 is fixedly attached to the drive shaft 18 and is wholly contained within the crank chamber 16. The swashplate 20 is mounted on the drive shaft 18 such that it is tilted away from a plane perpendicular to the longitudinal axis of the drive shaft 18. An assembly 42 can be incorporated into the compressor 10 such that the tilt angle of the swashplate 20 can be varied.

The cylinder block 12 defines the cylinder bore 26. The piston 28 is slideably disposed within the cylinder bore 26 such that the piston 28 can slide in and out of the bore 26. The slideable movement of the piston 28 is possible, at least in part, due to the presence of a narrow clearance between the interior surface of the cylinder block 12 in the cylinder bore 26 and the exterior surface of the piston 28.

Shoes 44 can be seated in a recess of the piston 28 and about the swashplate 20. The shoes 44 slideably intervene between the piston 28 and the swashplate 20 such that rotational movement of the swashplate 20 translates to linear reciprocating movement of the piston 28 within the cylinder bore 26.

It will be appreciated that, while FIG. 1 illustrates a variable angle swashplate compressor, the housing member according to the present invention can also be incorporated into fixed angle swashplate type compressors. Also, while FIG. 1 illustrates a single-acting piston, the housing member according to the present invention can also be incorporated into swashplate type compressors having double acting pistons. Furthermore, it will be appreciated that the type of lubricant used in the compressor is not critical to the invention. The grooves of the invention can be utilized to collect and distribute any suitable lubricant, including $CO_2$.

Figure 2:
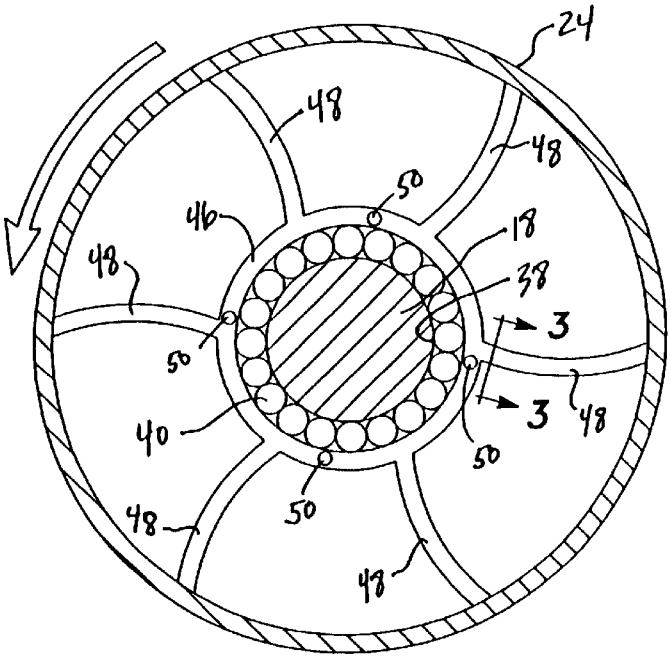
FIG. 2 is a cross-sectional view taken along line 2—2 of FIG. 1 and illustrates a housing member in accordance with a preferred embodiment of the present invention.

FIG. 2 illustrates the detail of a front housing member 24 in accordance with a preferred embodiment of the present invention. As indicated above, the front housing member 24 defines a main aperture 38 that receives the drive shaft 18. The housing member 24 further defines one or more grooves that are adapted to collect a lubricant that splashes against its surface due to the rotation of the swashplate and to direct the lubricant to the main aperture 38, where it can lubricate the bearing 40.

As illustrated in FIG. 2, the front housing member 24 preferably defines an annular groove 46 and a plurality of oil collection grooves 48 that are in fluid communication with the annular groove 46.

The annular groove 46 is preferably disposed around the main aperture 38, and has a generally circular form. As illustrated in FIG. 2, the front housing member 24 also preferably defines one or more axial holes 50. The axial holes 50 are preferably positioned within the annular groove 46 and preferably extend along an axis that is substantially perpendicular to the plane of the front housing member 24. The axial holes 50 provide fluid communication between the annular groove 46 and the bearing 40. As such, the axial holes 50 are adapted to carry lubricant from the annular groove 46 to the bearing 40 and drive shaft 18, thereby lubricating the interface between these members.

Preferably, as illustrated in FIG. 2, the front housing member 24 defines a plurality of axial holes 50 disposed within the annular groove 46 and evenly spaced from each other.

The oil collection grooves 48 are in fluid communication with the annular groove 46 and preferably extend outward from the annular groove 46. Each oil collection groove 48 is preferably in independent fluid communication with the annular groove 46.

The oil collection grooves 48 are preferably angled in their position on the front housing member 24. Preferably, as illustrated in FIG. 2, each groove 48 has a curvilinear from, slightly curving as the groove 48 extends outward from the annular groove 46.

Figure 3:
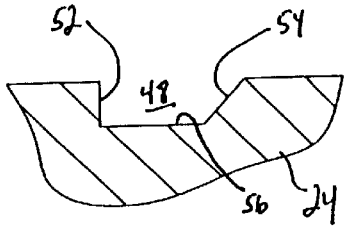
FIG. 3 is a cross-sectional view taken along line 3—3 of FIG. 2 and illustrates a preferred embodiment of an oil collection groove in accordance with the present invention.
Figure 4:
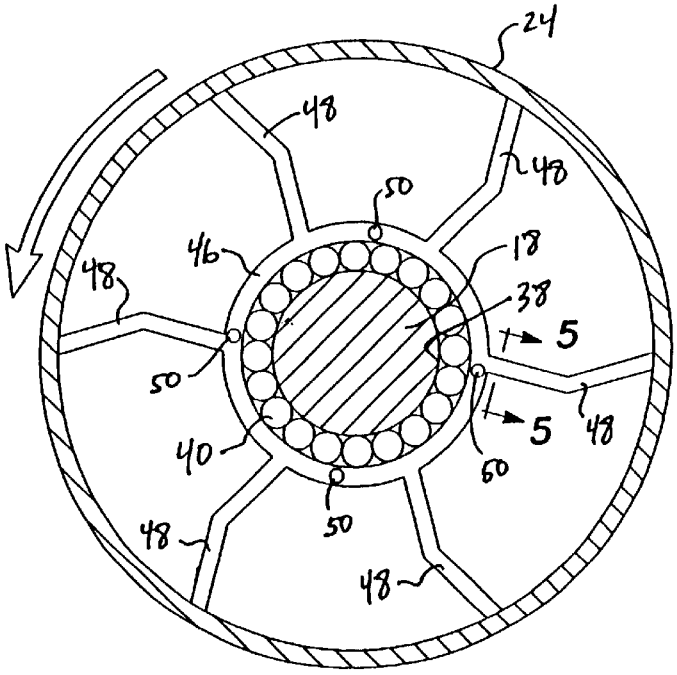
FIG. 4 is a cross-sectional view of a housing member in accordance with an alternate embodiment of the present invention.
Figure 5:
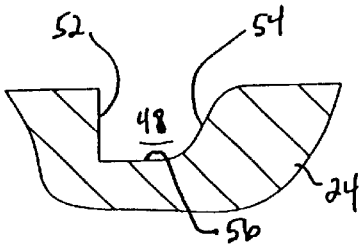
FIG. 5 is a cross-sectional view taken along line 5—5 of FIG. 4 and illustrates an alternate embodiment of an oil collection groove in accordance with the present invention.
Figure 6:
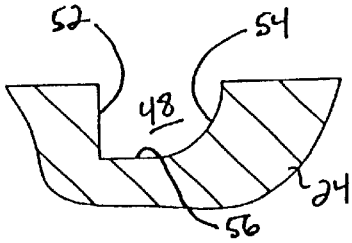
FIG. 6 is a cross-sectional view of an oil collection groove in accordance with a further alternate embodiment of the present invention.

Alternatively, as illustrated in FIG. 4, the oil collection grooves 48 can comprise two or more continuous linear segments joined at angles to each other. In this embodiment, the oil collection grooves 48 have a segmented appearance on the front housing member 24. FIG. 3 illustrates a cross-sectional view of one of the oil collection grooves 48. As illustrated in the figure, the groove 48 has a first wall 52 that is substantially perpendicular to the plane of the front housing member 24. Also, each groove 48 has a second wall 54 that is angled with respect to both the first wall 52 and the plane of the housing member 24. The second wall 54 can be flat, as illustrated in FIG. 3. Alternatively, as illustrated in FIGS. 5 and 6, the second wall 54 can have a curvilinear shape. The curvilinear shape of the second wall 54 can have a convex form, as illustrated in FIG. 5, or a concave form, as illustrated in FIG. 6. It will be understood that the grooves 48 illustrated in FIGS. 5 and 6 can be utilized with the preferred embodiment of the housing member, illustrated in FIG. 2, the alternate embodiment, illustrated in FIG. 4, or any other embodiment within the scope of the invention as defined by the appended claims.

The oil collection grooves 48 may further have a bottom surface 56 disposed between the first 52 and second 54 walls, effectively giving the groove 48 a channel form.

As indicated above, the oil collection grooves 48 collect a lubricant that is splashed against the front housing member due to the rotating motion of the swashplate. The second wall 54, with its angled arrangement, is adapted to allow the lubricant to flow down into the groove 48. Also, the first wall 52, with its substantially perpendicular arrangement, is adapted to abruptly stop the lubricant and direct it down the groove 48, toward the annular groove 46. To facilitate this movement of lubricant, the housing member 24 is preferably positioned in the compressor relative to the driveshaft such that the normal direction of rotation of the driveshaft proceeds from the second wall 54 to the first wall 52 of each oil collection groove 48.

As best illustrated in FIGS. 3 and 4, the front housing member preferably defines a plurality of oil collection grooves 48 extending outward from the annular groove 46. The number of oil collection grooves utilized can be optimized. based on the quantity of lubricant typically splashed against the front housing member 24 and the volume of the oil collection grooves 48. To maximize efficiency of the collection of lubricant by the oil collection grooves 48, the grooves 48 are preferably evenly spaced from each other on the surface of the front housing member 24.

The foregoing disclosure includes the best mode devised by the inventors for practicing the invention. It is apparent, however, that swashplate housing members incorporating various modifications and variations may be conceivable by a person skilled in the relevant art. Inasmuch as the foregoing disclosure is intended to enable such person to practice the instant invention, it should not be construed to be limited thereby but rather should be construed to include such aforementioned variations and be limited only by the spirit and scope of the following claims.

We claim:

1. A swashplate type compressor, comprising:

a cylinder block defining a cylinder bore and a crank chamber;

a housing member attached to the cylinder block and defining a main aperture, an annular groove disposed around the main aperture, and a plurality of oil collection grooves extending outward from the annular groove, each oil collection groove being in fluid communication with the annular groove and having a first wall that is substantially perpendicular to the plane of the housing member and a second wall that is angled with respect to the first wall and the plane of the housing member;

a bearing disposed in the main aperture;

a shaft rotatably mounted within the main aperture on the bearing such that one end of the shaft is disposed in the crank chamber;

a piston reciprocally disposed within the cylinder bore;

a swashplate fixedly mounted to the shaft and disposed within the crank chamber; and shoes which slideably intervene between the piston and the swashplate such that rotational movement of the swashplate translates to linear reciprocating movement of the piston within the cylinder bore.

2. The swashplate type compressor in accordance with claim 1, wherein the housing member is positioned relative to the shaft such that the normal direction of rotation of the shaft proceeds from the second wall to the first wall of each oil collection groove.

3. The swashplate type compressor in accordance with claim 1, wherein each oil collection groove is angled on the housing member.

4. The swashplate type compressor in accordance with claim 3, wherein each oil collection groove comprises two continuous linear segments joined at an angle.

5. The swashplate type compressor in accordance with claim 3, wherein each oil collection groove is curvilinear.

6. The swashplate type compressor in accordance with claim 3, wherein the housing member is positioned relative to the shaft such that the normal direction of rotation of the shaft proceeds from the second wall to the first wall of each oil collection groove.

7. The swashplate type compressor in accordance with claim 1, wherein the second wall of each oil collection groove is curvilinear.

8. The swashplate type compressor in accordance with claim 7, wherein the second wall of each oil collection groove has a convex cross-sectional shape.

9. The swashplate type compressor in accordance with claim 7, wherein the second wall of each collection groove has a concave cross-sectional shape.

10. The swashplate type compressor in accordance with claim 1, wherein each oil collection groove further comprises a bottom surface disposed between the first and second walls.

11. The swashplate type compressor in accordance with claim 1, wherein the housing member further defines an axial hole disposed within the annular groove and providing fluid communication between the annular groove and the bearing.

12. The swashplate type compressor in accordance with claim 11, wherein the housing member further defines a second axial hole disposed within the annular groove and providing fluid communication between the annular groove and the. bearing.

13. A housing member for a swashplate type compressor having a rotatable shaft, the housing member comprising:

a main body defining a main aperture adapted to rotatably receive said shaft, an annular groove disposed around the main aperture, and a plurality of oil collection grooves extending outward from the annular groove, each oil collection groove being in fluid communication with the annular groove and having a first wall that is substantially perpendicular to the plane of said housing member and a second wall that is angled with respect to the first wall and the plane of said housing member.

14. The housing member in accordance with claim 13, wherein each oil collection groove is angled on the housing member.

15. The housing member in accordance with claim 14, wherein each oil collection groove comprises two continuous linear segments joined at an angle.

16. The housing member in accordance with claim 14, wherein each oil collection groove is curvilinear.

17. The housing member in accordance with claim 13, wherein the second wall of each oil collection groove is curvilinear.

18. The housing member in accordance with claim 13, wherein the main body further defines an axial hole disposed within the annular groove and providing fluid communication between the annular groove and the main aperture.

19. The housing member in accordance with claim 18, wherein the main body further defines a second axial hole disposed within the annular groove and providing fluid communication between the annular groove and the main aperture.

20. A swashplate type compressor, comprising:

a cylinder block defining a cylinder bore and a crank chamber;

a housing member attached to the cylinder block and defining a main aperture, an annular groove disposed around the main aperture, and a plurality of oil collection grooves extending outward from the annular groove along an angled path, each oil collection groove being in fluid communication with the annular groove and having a first wall that is substantially perpendicular to the plane of the housing member, a curvilinear second wall, and a bottom surface disposed between the first and second walls;

a bearing disposed in the main aperture;

a shaft rotatably mounted within the main aperture on the bearing such that one end of the shaft is disposed in the crank chamber;

a piston reciprocally disposed within the cylinder bore;

a swashplate fixedly mounted to the shaft and disposed within the crank chamber; and shoes which slideably intervene between the piston and the swashplate such that rotational movement of the swashplate translates to linear reciprocating movement of the piston within the cylinder bore.

* * * * *